US005937967A

United States Patent [19]

Morgan

[11] Patent Number: 5,937,967

[45] Date of Patent: Aug. 17, 1999

[54] MOBILE SCAFFOLDING APPARATUS WITH RETRACTABLE WHEELS

[76] Inventor: Frank O. Morgan, 5631 W. Arrowhead Lakes Dr., Glendale, Ariz. 85308

[21] Appl. No.: 08/922,901

[22] Filed: Sep. 3, 1997

[51] Int. Cl.[6] ..... E06C 5/00

[52] U.S. Cl. ..... 182/17; 182/15

[58] Field of Search ..... 182/15, 17, 127, 182/12; 180/41; 280/763.1

[56] References Cited

U.S. PATENT DOCUMENTS

| | | | |
|---|---|---|---|
| 2,311,988 | 2/1943 | Lavin | 304/2 |
| 2,585,763 | 2/1952 | Gasnen . | |
| 2,624,590 | 1/1953 | Tilton . | |
| 3,923,320 | 12/1975 | Favreau et al. | 280/103 |
| 4,063,616 | 12/1977 | Gutierrez | 182/17 |
| 4,171,033 | 10/1979 | Rust et al. | 182/63 |
| 4,194,591 | 3/1980 | Fisher | 182/17 |
| 4,592,447 | 6/1986 | Ream et al. | 182/127 |
| 4,620,608 | 11/1986 | Gilbreath | 182/17 |
| 4,773,670 | 9/1988 | Raidel, II | 280/688 |
| 5,228,534 | 7/1993 | Haroldson, Sr. | 182/63 |
| 5,498,019 | 3/1996 | Adato | 280/675 |
| 5,509,506 | 4/1996 | Jones | 188/1.12 |
| 5,601,158 | 2/1997 | Klusmeyer et al. | 188/31 |

*Primary Examiner*—Alvin Chin-Shue
*Attorney, Agent, or Firm*—Charles E. Cates

[57] ABSTRACT

A mobile scaffolding apparatus having wheel support means which can be moved out of engagement with the ground. The wheel support means are mounted to a conventional scaffolding frame made of at least three, preferably four, vertical posts rigidly connected by bracing members. A foot pad is rigidly connected to the lower end of each of the vertical posts. When the wheel support means are moved into engagement with the ground, the mobile scaffolding apparatus rests upon the wheel support means and can travel. When the wheel support means are moved out of engagement with the ground, the mobile scaffolding apparatus rests stationary on the scaffolding frame foot pads. The wheel support means are moved into and out of engagement with the ground through either pivoting or retracting the wheel support means. There are two embodiments for pivoting the wheel support means. In both embodiments, the wheel support means have a wheel and axle assembly, a pivoting rod, and a brace member. One wheel support means assembly is attached to each of the vertical posts. The pivoting rod is pivotally mounted to the vertical post at one end with the wheel and axle assembly rigidly mounted to the opposite end. The brace member is pivotally mounted to the pivoting rod and braces the pivoting rod by engaging the vertical post. In one embodiment, the pivoting rod is held stationary when the brace member is placed in compression between the pivoting rod and the vertical post. In the alternative embodiment, the pivoting rod is braced when the brace member is placed in tension while holding the pivoting rod in a fixed position relative to the vertical post.

The present invention relates to the field of mobile scaffolding mounted on wheel assemblies.

3 Claims, 3 Drawing Sheets

FIG. 3
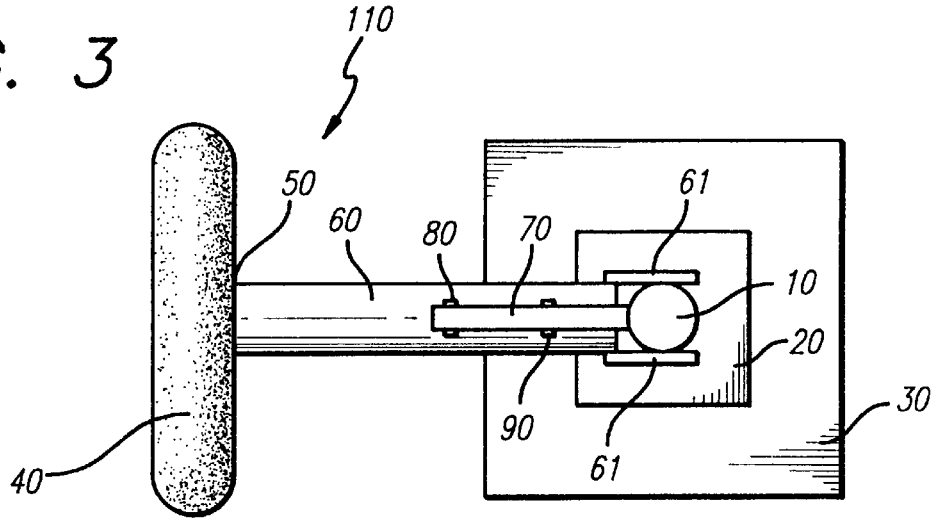
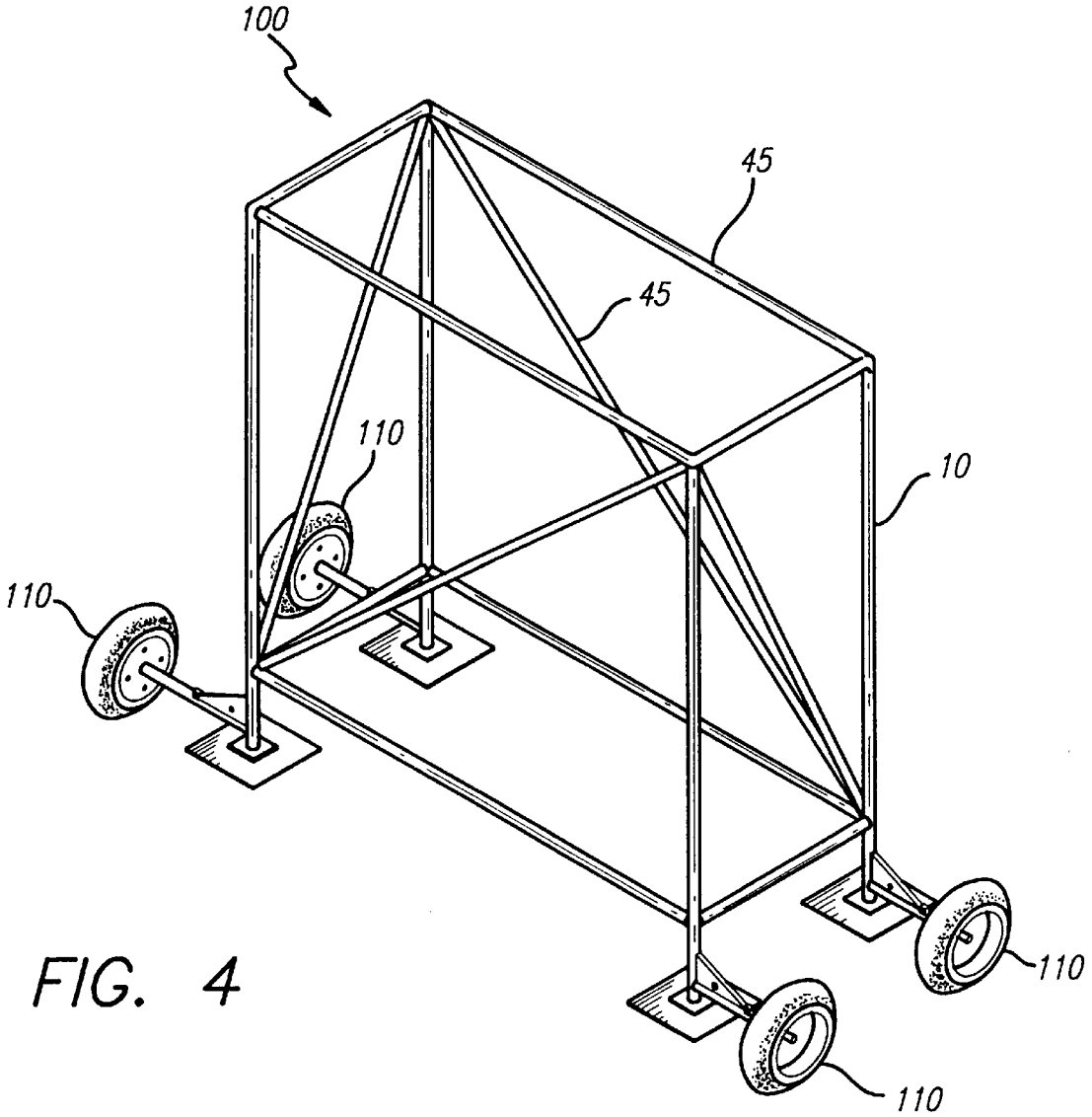
FIG. 4

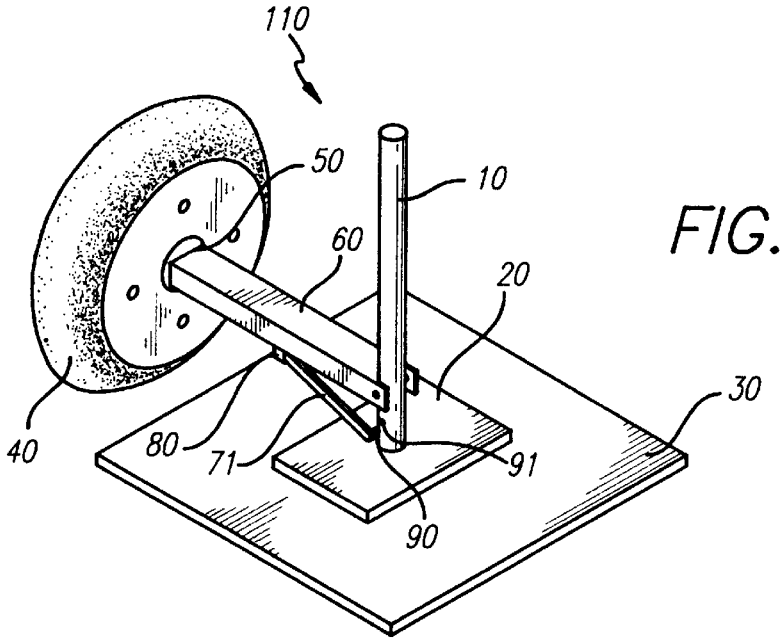
FIG. 5
FIG. 6
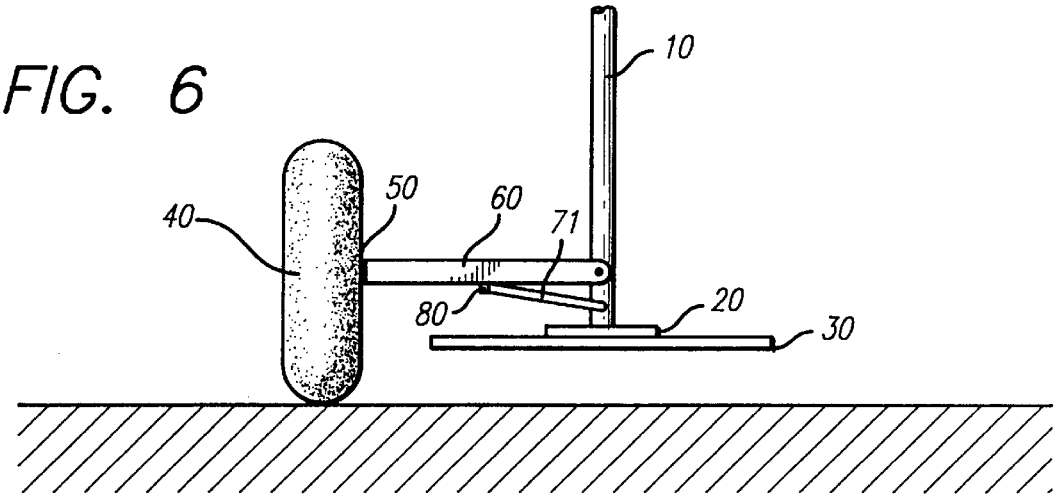
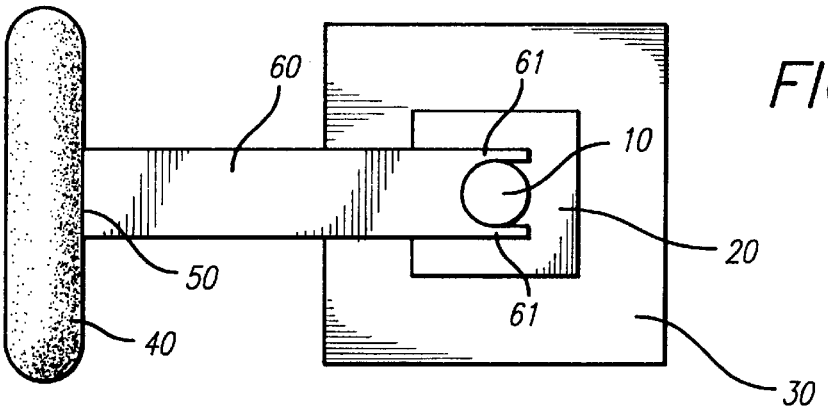
FIG. 7

MOBILE SCAFFOLDING APPARATUS WITH RETRACTABLE WHEELS

BACKGROUND OF THE INVENTION

Elevated working platforms have long been utilized in the construction and maintenance industries. Although various types of equipment have long been devised to safely support workers and equipment at elevated heights, probably the most commonly used equipment is portable scaffolding. Such scaffolding may be easily and quickly assembled, transported, and stored. Sections of scaffolding may be added or removed to selectively raise or lower the height of the working platform.

Forms of portable scaffolding are well known and many different species exist. In the prior art, mobile scaffolds commonly are mounted wheels with braking mechanisms. Examples of this type of scaffolding include: Favreau et. al., U.S. Pat. No. 3,923,320; Rust et. al., U.S. Pat. No. 4,171,033; and Haroldson, Sr., U.S. Pat. No. 5,228,534. Unlike this invention, where the scaffolding is immobilized by disengaging the brace wedge so that the scaffolding rests upon the foot pads, the three patents cited above disclose wheeled scaffolding devices, which are immobilized by conventionally applying brakes to the wheels rather than move the wheels out of engagement with the floor. Another common form of a mobile scaffolding device that exists in the prior art is pedestal scaffolding which can be tilted off of its base and onto a set of caster wheels for transport. Ream et. al., U.S. Pat. No. 4,592,447, is an example of this type of pedestal scaffolding.

This invention adds to this art through a novel wheel support means which can be moved from a fixed position supporting the scaffolding frame means on wheels to a disengaged position where the scaffolding rests upon the foot pads.

SUMMARY OF THE INVENTION

The primary object of the invention is to provide a safer scaffolding apparatus. Scaffolding is a tall, light weight metal structure which holds heavy individuals and equipment upon its top surface. In this "top heavy" condition, people and equipment can fall off the scaffolding causing injury. The scaffolding apparatus can be made safer, thus decreasing the chance of injury, through increasing the stability of the platform. This invention accomplishes this safety goal through enabling the wheel support means to be disengaged from contact with the ground to enable the scaffolding apparatus to rest on the more stable scaffolding frame means.

The invention comprises wheel support means mounted to a conventional scaffolding frame. The scaffolding frame is made of at least three vertical posts rigidly connected by bracing members. A foot pad is rigidly connected to the lower end of each of the vertical posts. When the wheel support means are moved into engagement with the ground, the mobile scaffolding apparatus rests upon the wheel support means and can travel. When the wheel support means are moved out of engagement with the ground, the mobile scaffolding apparatus rests stationary on the scaffolding frame foot pads.

The wheel support means are moved into and out of engagement with the ground through either pivoting or retracting the wheel support means. There are two embodiments for pivoting the wheel support means. In both embodiments, the wheel support means have a wheel and axle assembly, a pivoting rod, and a brace member. One wheel support means assembly is attached to each of the vertical posts. The pivoting rod is pivotally mounted to the vertical post at one end with the wheel and axle assembly rigidly mounted to the opposite end. The brace member is pivotally mounted to the pivoting rod and braces the pivoting rod by engaging the vertical post. In one embodiment, the brace member is pivotally mounted to the top portion of a pivoting rod and can operatively engage the side of a vertical post. When the brace member is in engagement with the vertical post, the weight of the scaffolding assembly presses against the brace member and pivoting rod, thus placing the brace member in a state of compression holding the pivoting rod in a stationary position. In this position the scaffolding frame rests upon the wheel support means and can travel. By pivoting the brace member out of engagement with the vertical post, the un-braced pivoting rod rotates to a position where the weight of the scaffolding is supported by a foot pad. In this position the scaffolding is stationary. In the alternative embodiment, the brace member is pivotally mounted to the bottom side of the pivoting rod and can engage a side of the vertical post. When the brace member is engaging the vertical post, the brace member is placed in a state of tension while holding the pivoting rod in a fixed position. When the brace member is pivoted out of engagement with the vertical post, the un-braced pivoting rod rotates to a position where the scaffolding frame rests upon the foot pads in a stationary position.

BRIEF DESCRIPTION OF THE DRAWINGS

FIG. 3 shows a top view of the invention.

FIG. 4 shows a perspective view of the invention.

FIG. 5 shows a perspective view of the invention.

FIG. 6 shows the invention resting upon the wheel support means.

FIG. 7 shows a top view of the invention.

DETAILED DESCRIPTION OF THE EMBODIMENT

Figure 1:
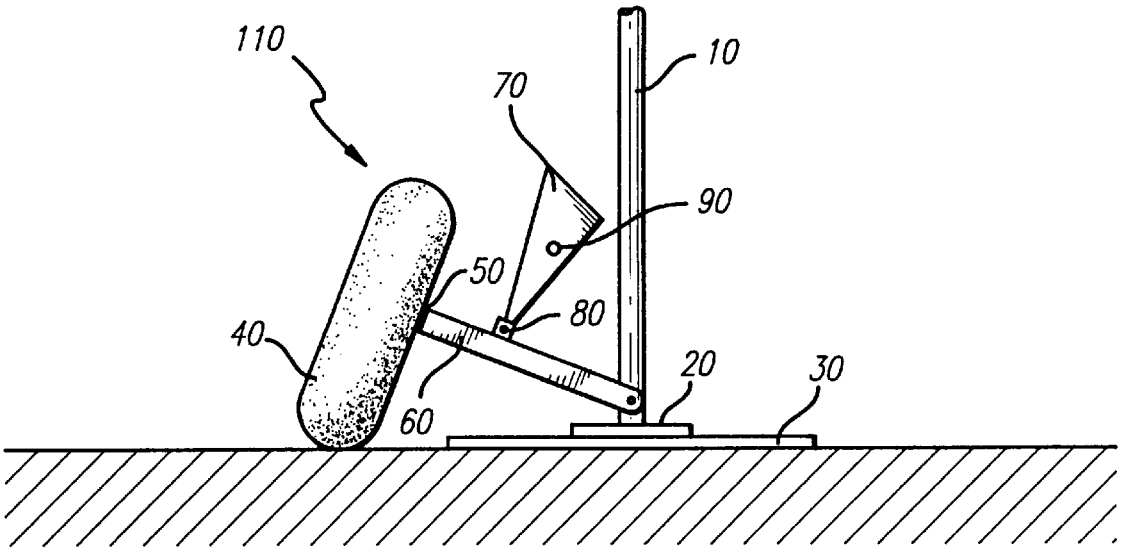
FIG. 1 shows a side view of the invention.
Figure 2:
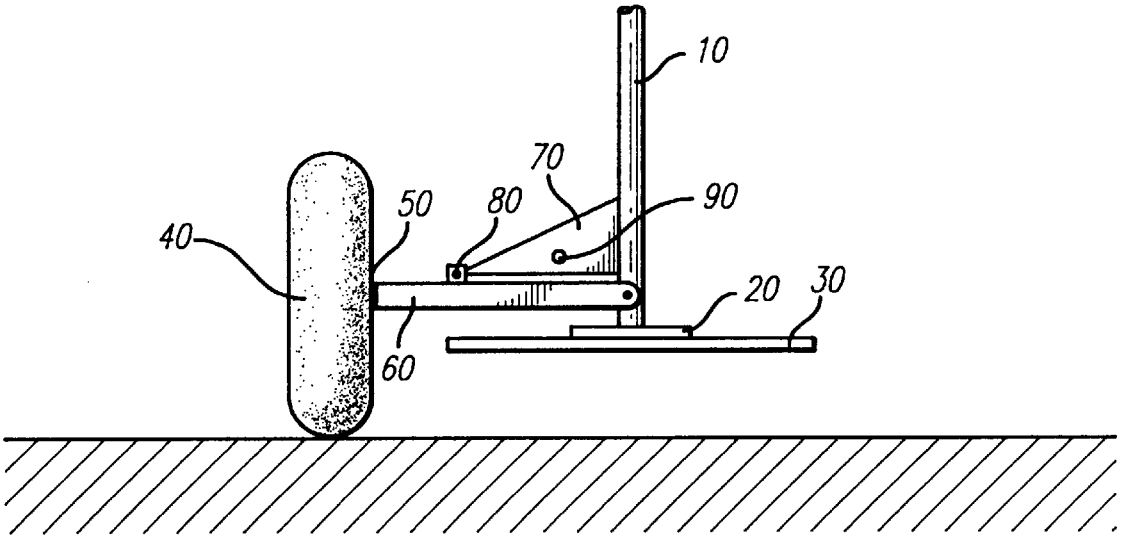
FIG. 2 shows the invention resting on the wheel support means.

FIGS. 1 through 7 show three preferred embodiments of the invention. FIGS. 1 through 3 show the embodiment of the invention where the brace wedge 70 is placed in a state of compression when engaging the pivoting rod 60 and the vertical scaffolding post 10. The vertical scaffolding post 10 is mounted to the scaffolding post plate 20 which is secured to the foot pad 30. The scaffolding post plate 20 strengthens the joint between the vertical scaffolding post 10 and the foot pad 30. The vertical scaffolding post 10, scaffolding post plate 20, foot pad 30, and frame brace means 45 shown in FIG. 5 comprise the scaffolding frame means 100. The wheel 40 is rotatably mounted on the axle 50. The axle 50 is fixed to the second end of the pivoting rod 60. The pivoting rod 60 is pivotally mounted to the lower portion of the vertical scaffolding post 10. The brace wedge 70 is pivotally mounted to the pivoting rod 60 by the hinge assembly 80. To pivot the brace wedge 70, and operator will apply force to the pull pin 90 mounted to the brace wedge. The wheel 40, axle 50, pivoting rod 60, brace wedge 70, hinge assembly 80, and pull pin 90 comprise the pivoting wheel support means 110.

FIG. 1 shows the invention in a stationary position resting on the foot pad 30. The brace wedge 70 is shown disengaged from the vertical scaffolding post 10 thereby enabling the pivoting rod 60 to rotate freely. The scaffolding, not able to be supported by the freely pivoting wheel support means, therefore rests upon the foot pad 30.

FIG. 2 shows the invention in a mobile position resting upon the pivoting wheel support means 110. The brace wedge 70 is engaged to the vertical scaffolding post 10 bracing the pivoting wheel rod 60 in a fixed position. While the brace wedge is engaging the vertical scaffolding post 10, the invention may travel freely upon the wheel 40. To disengage the brace wedge 70 from the vertical scaffolding post 10, an operator will apply force to the pull pin 90 pulling the pull pin 90 and the brace wedge 70 away from the vertical scaffolding post 10. Once the brace wedge 70 has been pulled out of engagement with the vertical scaffolding post 10, the pivoting rod 60 can rotate freely and the invention then rests upon the foot pad 30.

FIG. 3 shows a top view of the invention. The vertical scaffolding post 10 is mounted to the scaffolding post plate 20 which is secured to the foot pad 30. The wheel 40 is rotatably mounted on the axle 50. The axle 50 is fixed to the second end of the pivoting rod 60. The pivoting rod 60 is pivotally mounted to the lower portion of the vertical scaffolding post 10 through the use of side plates 61 which are secured to the pivoting rod 60 and pivotally mount to the vertical scaffolding post 10. The brace wedge 70 is pivotally mounted to the pivoting rod 60 by the hinge assembly 80. To pivot the brace wedge 70, and operator will apply force to the pull pin 90 mounted to the brace wedge.

FIG. 4 shows an isometric view of the scaffolding frame means 100 mounted to the pivoting wheel support means 110. In this preferred embodiment, four vertical scaffolding posts 10 have been used with one pivoting wheel support means assembly 110 attached to each of the four vertical scaffolding posts 10. In this view, each pivoting wheel support assembly 110 has the brace wedge 70 engaged to the vertical scaffolding post 10. The pivoting rod 60 is therefore braced in a fixed position and the scaffolding frame means 100 is thereby supported upon the wheels 40. To lower the scaffolding frame means 100 into a stationary position upon the foot pads 30, an operator would pull on the pull pins 90 until the brace wedge 70 on each of the four pivoting wheel support means assemblies 110 in this preferred embodiment have been pulled out of engagement with the vertical scaffolding post 10.

FIGS. 5, 6 and 7 show the embodiment of the invention where the brace wedge 71 is placed in a state of tension when engaging the pivoting rod 60 and the vertical scaffolding post 10. FIG. 5 shows a perspective view of the invention. The vertical scaffolding post 10 is mounted to the scaffolding post plate 20 which is secured to the foot pad 30. The scaffolding post plate 20 strengthens the joint between the vertical scaffolding post 10 and the foot pad 30. The vertical scaffolding post 10, scaffolding post plate 20, foot pad 30, and frame brace means 45 shown in FIG. 3 comprise the scaffolding frame means 100. The wheel 40 is rotatably mounted on the axle 50. The axle 50 is fixed to the second end of the pivoting rod 60. The pivoting rod 60 is pivotally mounted to the lower portion of the vertical scaffolding post 10. The brace wedge 71 is pivotally mounted to the pivoting rod 60 by the hinge assembly 80. To pivot the brace wedge 71, and operator will apply force to the pull pin 90 mounted to the brace wedge. Brace wedge 71 is removably engaged to vertical scaffolding post 10 by inserting pull pin 90 into aperture 91 in the vertical scaffolding post. The wheel 40, axle 50, pivoting rod 60, brace wedge 71, hinge assembly 80, and pull pin 90, and aperture 91 comprise the pivoting wheel support means 110.

FIG. 5 shows the invention in a stationary position resting on the foot pad 30. The brace wedge 71 is shown disengaged from the vertical scaffolding post 10 thereby enabling the pivoting rod 60 to rotate freely. The scaffolding, not able to be supported by the freely pivoting wheel support means, therefore rests upon the foot pad 30.

FIG. 6 shows the invention in a mobile position resting upon the pivoting wheel support means 110. The brace wedge 71 is engaged to the vertical scaffolding post 10 bracing the pivoting wheel rod 60 in a fixed position. While the brace wedge 71 is engaging the vertical scaffolding post 10, the invention may travel freely upon the wheel 40. To disengage the brace wedge 71 from the vertical scaffolding post 10, an operator will apply force to the pull pin 90 out of aperture 91 pulling the pull pin 90 and the brace wedge 71 away from the vertical scaffolding post 10. Once the brace wedge 71 has been pulled out of engagement with the vertical scaffolding post 10, the pivoting rod 60 can rotate freely and the invention then rests upon the foot pad 30.

FIG. 7 shows a top view of the invention. The vertical scaffolding post 10 is mounted to the scaffolding post plate 20 which is secured to the foot pad 30. The wheel 40 is rotatably mounted on the axle 50. The axle 50 is fixed to the second end of the pivoting rod 60. The pivoting rod 60 is pivotally mounted to the lower portion of the vertical scaffolding post 10 through the use of side plates 61 which are secured to the pivoting rod 60 and pivotally mount to the vertical scaffolding post 10.

I claim:

1. A movable scaffolding apparatus comprising:

a. Scaffolding frame means, comprising:

i. At least three vertical scaffolding posts having upper and lower ends, said vertical posts having a lower portion above the lower end;

ii. Frame brace means rigidly connecting said vertical scaffolding posts; and iii. A foot pad being fixed to the lower end of each of the said vertical scaffolding posts; and b. a wheel support means comprising:

i. a wheel and axle assembly; and ii. positioning means connecting said wheel and axle assembly to said scaffolding frame means, said position means moves said wheel and axle assembly between an engaged position where said scaffolding frame means rests upon said wheel and axle assembly and a disengaged position where said scaffolding frame means rests upon said foot pads, said positioning means comprises: a pivoting rod having a first end and a second end, the first end of said pivoting rod being pivotally mounted to said lower portion of said vertical scaffolding post, said wheel and axle assembly being fixed to the second end of said pivoting rod, wherein the axle of the assembly constitute an axial extension of said rod; a brace wedge pivotally mounted on said rod and pivoting into engagement with said scaffolding post bracing said pivoting rod in a fixed position thereby resting said scaffold frame means on said wheel support means thereby permitting the frame means to travel on said wheel support means, whereby pivoting said brace wedge out of engagement with said vertical post permits said pivoting rod to pivot freely thereby resting the frame means on said foot pad.

2. The movable scaffolding apparatus of claim 1 wherein said brace wedge is pivotally mounted on the surface of said pivoting rod, said brace wedge being in a state of compression when pivoted into engagement with said vertical scaffolding post.

3. The movable scaffolding apparatus of claim 1 wherein said brace wedge is pivotally mounted on the surface of said pivoting, said brace wedge being in a state of tension when pivoted into engagement with said vertical scaffolding post.

* * * * *